US009542954B2

(12) United States Patent
Baum et al.

(10) Patent No.: US 9,542,954 B2
(45) Date of Patent: Jan. 10, 2017

(54) METHOD AND APPARATUS FOR WATERMARKING SUCCESSIVE SECTIONS OF AN AUDIO SIGNAL

(71) Applicant: THOMSON LICENSING, Issy de Moulineaux (FR)

(72) Inventors: Peter Georg Baum, Hannover (DE); Xiaoming Chen, Hannover (DE); Michael Arnold, Isernhagen (DE); Ulrich Gries, Hannover (DE)

(73) Assignee: THOMSON LICENSING, Issy les Moulineaux (FR)

( * ) Notice: Subject to any disclaimer, the term of this patent is extended or adjusted under 35 U.S.C. 154(b) by 31 days.

(21) Appl. No.: 14/613,435

(22) Filed: Feb. 4, 2015

(65) Prior Publication Data

US 2015/0221317 A1 Aug. 6, 2015

(30) Foreign Application Priority Data

Feb. 6, 2014 (EP) ..... 14305165

(51) Int. Cl.
*G10L 19/00* (2013.01)
*G10L 19/018* (2013.01)

(52) U.S. Cl.
CPC ..... *G10L 19/018* (2013.01)

(58) Field of Classification Search
USPC ..... 704/200–232, 500–504
See application file for complete search history.

(56) References Cited

U.S. PATENT DOCUMENTS 5,161,210 A * 11/1992 Druyvesteyn ..... G10L 19/018 704/200
5,822,360 A * 10/1998 Lee ..... G10L 19/018 370/493

(Continued)

FOREIGN PATENT DOCUMENTS

EP WO9827504 6/1998
EP WO0022772 4/2000

(Continued)

OTHER PUBLICATIONS

Cvejic etal:"Audio prewhitening based on polynomial filtering for optimal watermark detection", Proceedings of XI European Signal Processing Conference 2002, Sep. 3, 2002, pp. 69-72.

(Continued)

*Primary Examiner* — Jesse Pullias
(74) *Attorney, Agent, or Firm* — Tutunjian & Bitetto, P.C.

(57) ABSTRACT

Audio watermarking is the process of embedding watermark information items into an audio signal in an in-audible manner. In a first embodiment, in case the original audio signal has parts of low signal energy, an alternative signal having a level or strength given by the psycho-acoustic model is combined with the original audio signal. The combined signal is watermarked with watermark data to be embedded. In a second embodiment, in case the original audio signal has parts of low signal energy, an alternative signal having a level or strength given by the psycho-acoustic model is watermarked with watermark data to be embedded, and the audio signal is watermarked with the watermark data to be embedded. The watermarked alternative signal is combined with the watermarked audio signal.

10 Claims, 2 Drawing Sheets

(56) References Cited

U.S. PATENT DOCUMENTS

| | | | | |
|---|---|---|---|---|
| 6,512,796 | B1 * | 1/2003 | Sherwood | G10L 19/018 375/242 |
| 6,674,861 | B1 * | 1/2004 | Xu | G10L 19/018 380/252 |
| 6,845,360 | B2 * | 1/2005 | Jensen | H04H 20/31 341/52 |
| 2001/0032313 | A1 | 10/2001 | Haitsma et al. | |
| 2011/0246202 | A1 | 10/2011 | McMillan et al. | |
| 2012/0281894 | A1 | 11/2012 | Vlachos et al. | |
| 2013/0103172 | A1 * | 4/2013 | McMillan | G10L 19/018 700/94 |

FOREIGN PATENT DOCUMENTS

| | | |
|---|---|---|
| EP | 2375411 | 10/2011 |
| WO | WO2007031423 | 3/2007 |
| WO | WO2011104233 | 9/2011 |
| WO | WO2011104283 | 9/2011 |

OTHER PUBLICATIONS

Ko etal: "Time-spread echo method for digital audio watermarking", IEEE Transactions on Multimedia, vol. 7, No. 2, Apr. 2005; pp. 212-221.

Petrovic: "Audio signal watermarking based on replica modulation", TELSIKS 2001, Sep. 19-21, 2001, pp. 227-234.

Yeo et al: "Modified Patchwork Algorithm (1): A novel audio watermarking scheme", IEEE Transactions on Speech and Dudio Processing, vol. 11, No. 4, Jul. 2003; pp. 381-386.

Yeo et al: "Modified patachwork algorithm (2): A novel audio watermarking scheme", Department of Control and Instrumentation Engineering, Kangwon National University, Chunchon 200-701, Korea, IEEE, 2001; pp. 237-242.

Zhang et al: "An adaptive audio watermarking algorithm based on capstrum transform", 2012 Fifth International Joint Conference on Cumputational Sciences and Optimization, 2012; pp. 806-809.

Search Report Dated May 12, 2014.

* cited by examiner

METHOD AND APPARATUS FOR WATERMARKING SUCCESSIVE SECTIONS OF AN AUDIO SIGNAL

This application claims the benefit, under 35 U.S.C. §119 of European Patent Application No. 14305165.4, filed Feb. 6, 2014.

TECHNICAL FIELD

The invention relates to a method and to an apparatus for watermarking successive sections of an audio signal, wherein the watermarking is controlled by a psycho-acoustical model.

BACKGROUND

Audio watermarking is the process of embedding information items (called watermark) into an audio signal in an inaudible manner.

An original audio signal $c_o$ can be considered as representing a channel for conveying watermark information m using a key k. In turn, watermarking can be modelled as a form of communication. There exist different ways of how to incorporate the original signal $c_o$ into the communication model. In a basic model the original signal $c_o$ is considered as a noise signal. The information about the host signal is not exploited in the modulation step. In advanced models the original audio signal is examined in the watermark encoder before adding a corresponding watermark signal w. This kind of processing is usually referred to as "watermarking with informed embedding" or simply "informed embedding". In such case the watermark signal w is shaped according to a perceptual model and is then applied to the host signal in the modulation step.

SUMMARY OF INVENTION

Known informed embedding systems can implement different modulation modules $f(m,k,c_o)$ for generating a watermarked original audio signal $c_w$ from the original audio signal $c_o$, which however can result in robustness problems. This is the case in audio signals containing only minimal energy in low frequencies (like special sound effects in a movie), or in artificial signals containing time sections with digital zeroes. If the modulation $f(m,k,c_o)$ consists of a multiplicative embedding rule, incorporating the host signal (see equation below), there is essentially nothing embedded.

$$c_w=f(m,k,c_o)$$

$$c_w=(1+w(m,k,c_o))\times c_o$$

The modulation of the original signal can be done in the media space (i.e. audio samples) or can be performed in a transformed domain (e.g. in the Fourier domain). Thus $c_o$ and $c_w$ can represent audio samples in time domain or Fourier magnitudes/phases in the transformed domain. The latter is performed in watermarking based on Spread Spectrum processing which are most widely used in audio watermarking. Another important class of audio watermarking methods are time-spread echo hiding methods, for which the modulation function can be written as $c_w=c_o*h(m,k,c_o)$ with the convolution operator '*' and the echo kernel $h(m,k,c_o)$, having the same difficulty if $c_o$ has sections containing digital zeroes. I.e., the two most important audio watermarking type classes have problems if the audio signal has very low signal energy or contains digital zero values.

In a one embodiment of the described processing, in case the original audio signal has parts of low signal energy, an alternative signal having a level or strength given by the psycho-acoustic model is combined with the original audio signal. The combined signal is watermarked with watermark data to be embedded.

This kind of processing represents a combination of a multiplicative embedding rule and an additive embedding rule.

The described processing improves the robustness of audio watermarking systems in particular for signal sections which have very low signal energy in the full time frequency range or in parts of the time frequency range, resulting in significantly improved audio watermark detection at decoder or receiver side. Advantageously, any suitable watermark detection at decoder or receiver side can be used without modification.

In principle, the described processing is suited for watermarking successive sections of an audio signal, comprising the steps:

- calculating using a psycho-acoustical model a masking curve for a current section of said audio signal, and determining for said current section of said audio signal whether it contains low signal energy or parts of low signal energy;
- providing an alternative signal different from said audio signal, which is controlled by said low signal energy determination and the strength of which is controlled by said masking curve;
- combining said alternative signal with said audio signal in case said current section of said audio signal has low signal energy or parts of low signal energy, so as to provide a combined signal;
- watermarking said combined signal, controlled by watermark data to be embedded and by said masking curve, so as to provide a watermarked audio signal.

In principle the described apparatus is suited for watermarking successive sections of an audio signal, said apparatus comprising means being adapted for:

- calculating using a psycho-acoustical model a masking curve for a current section of said audio signal, and determining for said current section of said audio signal whether it contains low signal energy or parts of low signal energy;
- providing an alternative signal different from said audio signal, which is controlled by said low signal energy determination and the strength of which is controlled by said masking curve;
- combining said alternative signal with said audio signal in case said current section of said audio signal has low signal energy or parts of low signal energy, so as to provide a combined signal;
- watermarking said combined signal, controlled by watermark data to be embedded and by said masking curve, so as to provide a watermarked audio signal.

BRIEF DESCRIPTION OF DRAWINGS

Exemplary embodiments of the processing are described with reference to the accompanying drawings, which show in.

DESCRIPTION OF EMBODIMENTS

Figure 1:
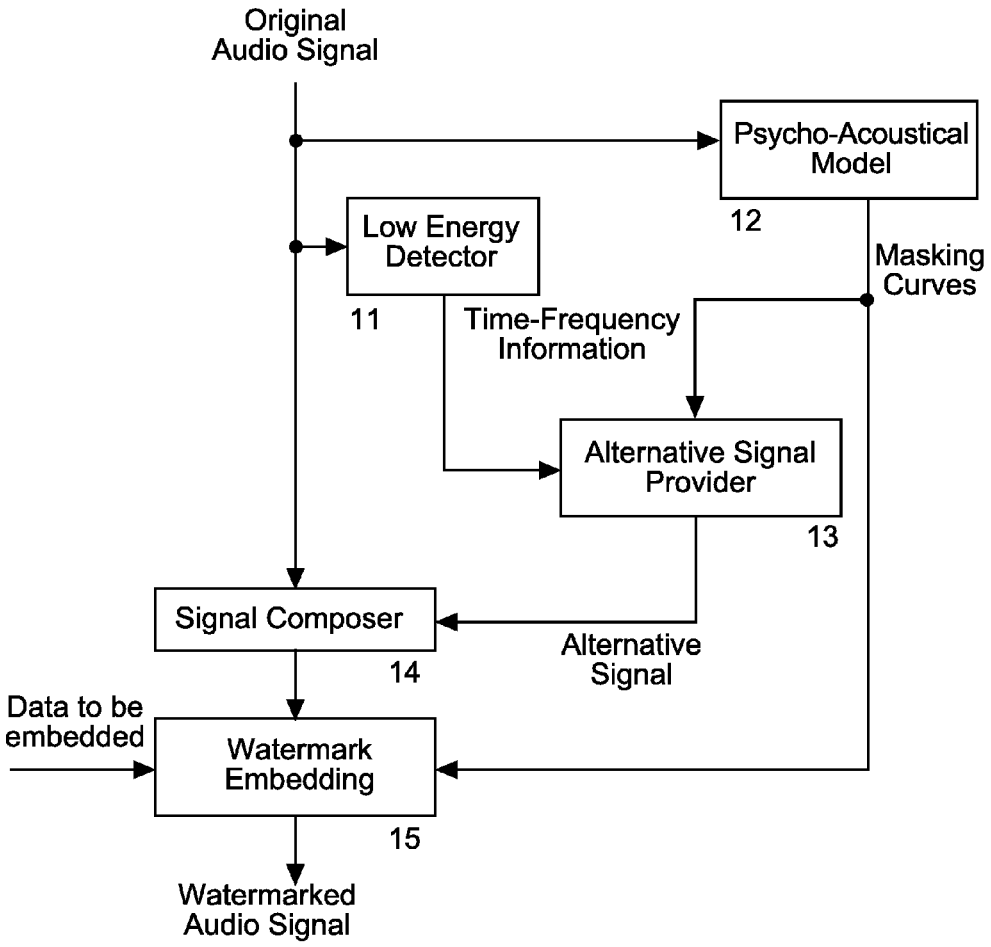
FIG. 1 block diagram of a first embodiment for watermarking processing using the described processing.

Even if not explicitly described, the following embodiments may be employed in any combination or sub-combination.

The described processing improves the detection in audio watermarking systems that are using the audio signal itself as watermark carrier and the audio signal itself is transformed, but the watermark is not an external watermarked signal added to the audio signal where that external signal is watermarked independently from the current content of the audio signal.

The affected systems are for example multiplicative embedding systems as described e.g. in I. K. Yeo and H. J. Kim, "Modified patchwork algorithm: A novel audio watermarking scheme", Proceedings of the IEEE International Conference on Information Technology: Coding and Computing, 2001, pp. 237-242, 2-4 Apr. 2001.

Other systems which add a scaled and time delayed version of the original content as a watermark are echo hiding systems as described e.g. in B. S. Ko, R. Nishimura, Y. Suzuki, "Time-spread echo method for digital audio watermarking", IEEE Transactions on Multimedia, vol. 7, no. 2, pp. 212-221, April 2005, and in R. Petrovic, "Audio Signal Watermarking based on Replica Modulation", 5th International Conference on Telecommunications in Modern Satellite, Cable and Broadcasting Service, pp. 227-234, 19-21 Sep. 2001.

It is common practice in audio signal processing to apply a short-time Fourier transform (STFT) for obtaining a time-frequency representation of the signal, so as to mimic the behavior of the ear. This results in a collection of DFT-transformed (discrete Fourier transform) and windowed overlapped audio signal section blocks (overlap-add-processing as such is well-known). For watermarking purposes each audio block is analyzed to calculate the (psycho-acoustically) allowed size of modification, and finally the audio block signal values are modified according to this analysis by embedding the watermark information.

However, this known kind of processing has its limits if the signal in a block has only very low signal energy in parts of the time-frequency range or in the full time-frequency range. A signal containing for example only digital zero amplitude values will not be watermarked at all if a multiplicative embedding rule is employed. An audio signal section containing only low frequencies, which often occurs as an effect in movies, can use only the low frequencies for the watermark-related modifications, which means that the watermark is less robust as compared to when the full frequency range can be used for the modifications.

According to the described processing, additive and multiplicative embedding rules are combined in a single watermarking system, by generating an alternative signal within the time-frequency range for signal sections in which the original audio signal does have low signal energy. This alternative signal is dependent on the data to be embedded and ensures high watermark detection strength. It is scaled or shaped using a psycho-acoustical model, such that inaudibility is ensured. Such alternative signals are different from the original audio signal and can be for examples white noise signals or pink noise signals. The alternative signal is combined with the watermarked audio signal and thereby produces the final watermarked audio signal. The combination rule can be for example adding or substituting, depending on the underlying watermarking principle.

Because of the combination with the alternative signal, watermarks can be embedded even in problematic audio signal sections, and the final encoder or transmitter audio output signal is more robust: the decoder or receiver side device can more reliably detect the watermark, without any noise from the alternative signal becoming audible. The watermark detection at decoder or receiver side requires no modification: for example, a known processing using correlation with candidate bit pattern sequences, detecting magnitude value peaks in the correlation result and selecting the watermark bit or word corresponding to that bit pattern sequence which leads to the highest peak value. While with the state of the art technology the detector would receive a 'watermarked' audio signal with digital zeros, it could not detect the current watermark symbol. With the described processing used, however, the detector receives a non-zero alternative signal which produces a good watermark symbol detection result.

In FIG. 1 successive sections of an original audio signal are fed to a low signal energy detector step or stage 11, a psycho-acoustical model calculator step or stage 12 and a signal composer step or stage 14. Psycho-acoustical model calculator 12 calculates a masking curve for every original audio signal section—even in silence two effects of the human auditory system can be exploited: the hearing threshold in quiet (the human ear is not able to hear signals having an energy below a frequency dependent energy threshold) and temporal masking (if the signal power drops suddenly to zero, the human ear is not able to hear a signal with an energy below a certain level which is dependent on the distance to the drop).

Signal composer 14 provides its output signal to a watermark embedding step or stage 15 which outputs a watermarked audio signal.

Low signal energy detector 11 determines low energy sections or partial low energy sections within time-frequency information, e.g. signal sections containing zero values, and provides an alternative signal provider step or stage 13 with such information. In case a low signal energy part is detected, alternative signal provider 13 generates an alternative signal for composing it in composer 14 with the original audio signal. The 'alternative signal' is a signal which produces the best detection results at detector or receiver side while at the same time being inaudible. An example alternative signal is white or pink noise generated according to the hearing threshold in quiet. To that alternative signal the above-described modulation with a multiplicative rule is applied according to the watermark data or symbol to be embedded. Watermark embedder 15 gets on one hand watermark data to be embedded and on the other hand a current masking curve from psycho-acoustical model calculator 12.

The current masking curve is also provided to alternative signal provider 13 for controlling for which signal values of the original audio signal it outputs with which amplitude alternative signal values to be combined in step/stage 14 with original values of the original audio signal.

The watermark data to be embedded in watermark embedder 15 can be a bit sequence selected from a set of pseudo-random bit sequences modulated according to a watermark information bit value. The bit sequence can be used in step/stage 15 for correspondingly modulating the phase of the combined signal to be watermarked, e.g. in a manner described in WO 2007/031423 A1.

Figure 2:
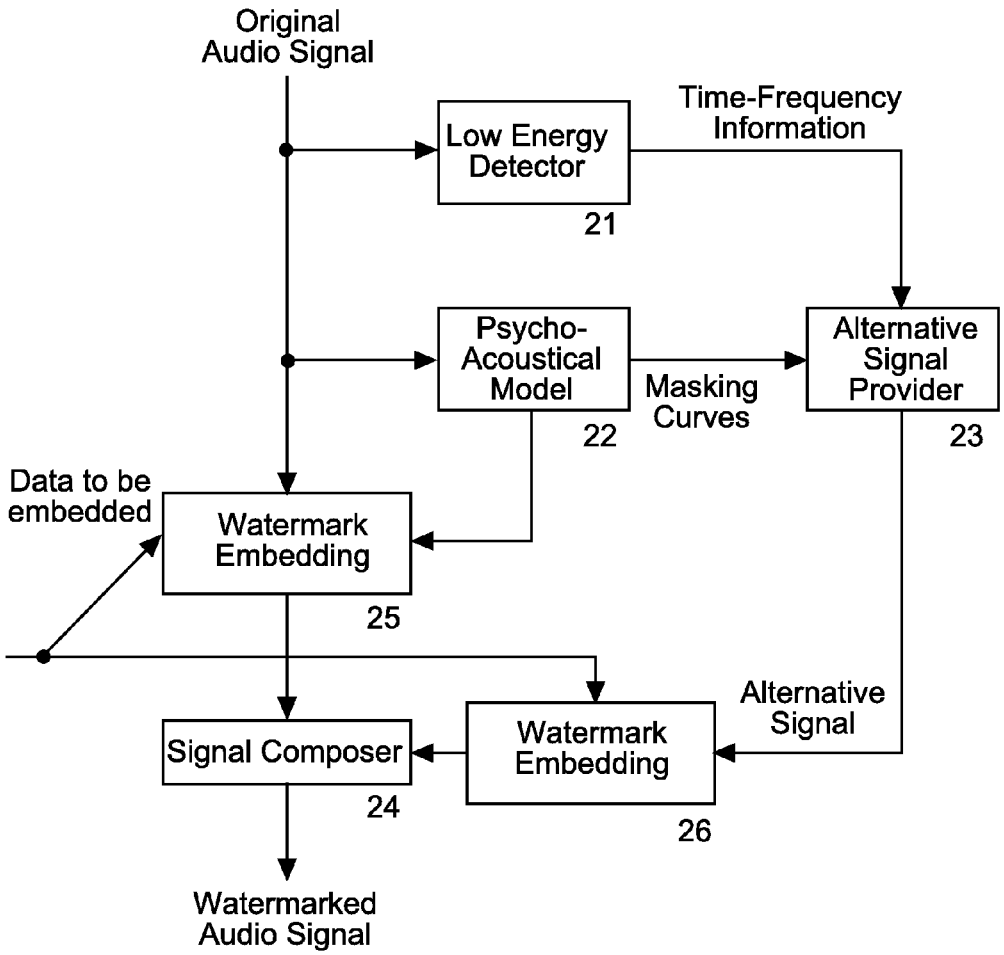
FIG. 2 block diagram of a second embodiment for watermarking processing using the described processing.

In FIG. 2 successive sections of an original audio signal are fed to a low signal energy detector step or stage 21, a psycho-acoustical model calculator step or stage 22 and a watermark embedding step or stage 25. Psycho-acoustical model calculator 22 calculates a masking curve for every original audio signal section. Watermark embedder 25 gets on one hand watermark data to be embedded and on the other hand a current masking curve from psycho-acoustical model calculator 22.

Watermark embedder 25 provides its output signal to a signal composer step or stage 24 which outputs a watermarked audio signal.

Low signal energy detector 21 determines low energy sections or partial low energy sections within time-frequency information, e.g. signal sections containing zero values, and provides an alternative signal provider step or stage 23 with such information. In case a low signal energy part is detected, alternative signal provider 23 generates an alternative signal (e.g. white or pink noise) that is watermarked in a further watermark embedding step or stage 26 according to the watermark data to be embedded.

The further watermark embedder 26 provides its output signal to signal composer 24 which combines the watermarked alternative signal with the watermarked original audio signal. The current masking curve is also provided to alternative signal provider 23 for controlling for which signal values of the original audio signal it outputs with which amplitude alternative signal values to be watermarked in step/stage 26 and to be combined in step/stage 24 with original values of the original audio signal.

Watermark embedders 25 and 26 carry out the same kind of operation. The watermark data to be embedded in watermark embedders 25 and 26 can be a bit sequence selected from a set of pseudo-random bit sequences modulated according to a watermark information bit value. The bit sequence can be used in steps/stages 25 and 26 for correspondingly modulating the phase of the signals to be watermarked, e.g. in a manner described in WO 2007/031423 A1.

The described processing can be carried out by a single processor or electronic circuit, or by several processors or electronic circuits operating in parallel and/or operating on different parts of the described processing.

The invention claimed is:

1. A method for watermarking successive sections of an audio signal, comprising:

calculating using a psycho-acoustical model a masking curve for a current section of said audio signal, and determining for said current section of said audio signal whether it contains low signal energy or parts of low signal energy;

providing an alternative signal different from said audio signal, which is controlled by said low signal energy determination and the strength of which is controlled by said masking curve;

combining said alternative signal with said audio signal in case said current section of said audio signal has low signal energy or parts of low signal energy, so as to provide a combined signal;

watermarking said combined signal, controlled by watermark data to be embedded and by said masking curve, so as to provide a watermarked audio signal.

2. The method according to claim 1, wherein said masking curve calculation and said low signal energy determination are performed in the frequency domain.

3. The method according to claim 1, wherein said alternative signal is a white or pink noise signal.

4. The method according to claim 1, wherein said watermark data to be embedded is a bit sequence selected from a set of pseudo-random bit sequences modulated according to a watermark information bit value.

5. The method according to claim 4, wherein said bit se-quence is used for modulating the phase of the signals to be watermarked.

6. An apparatus for watermarking successive sections of an audio signal, said apparatus comprising:

a calculator using a psycho-acoustical model which calculates a masking curve for a current section of said audio signal, and which determines for said current section of said audio signal whether it contains low signal energy or parts of low signal energy;

a source which provides an alternative signal different from said audio signal, which is controlled by said low signal energy determination and the strength of which is controlled by said masking curve;

a combiner which combines said alternative signal with said audio signal in case said current section of said audio signal has low signal energy or parts of low signal energy, so as to provide a combined signal;

a watermarker which watermarks said combined signal, controlled by watermark data to be embedded and by said masking curve, so as to provide a watermarked audio signal.

7. The apparatus according to claim 6, wherein said masking curve calculation and said low signal energy determination are performed in the frequency domain.

8. The apparatus according to claim 6, wherein said alterna-tive signal is a white or pink noise signal.

9. The apparatus according to claim 6, wherein said water-mark data to be embedded is a bit sequence selected from a set of pseudo-random bit sequences modulated according to a watermark information bit value.

10. The apparatus according to claim 9, wherein said bit se-quence is used for modulating the phase of the signals to be watermarked.

* * * * *